US008485263B2

(12) United States Patent
Lembcke

(10) Patent No.: US 8,485,263 B2
(45) Date of Patent: Jul. 16, 2013

(54) MULTI-SLEEVE PLUNGER FOR PLUNGER LIFT SYSTEM

(75) Inventor: Jeffrey J. Lembcke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 369 days.

(21) Appl. No.: 12/897,404

(22) Filed: Oct. 4, 2010

(65) Prior Publication Data

US 2012/0080198 A1 Apr. 5, 2012

(51) Int. Cl.
*E21B 43/00* (2006.01)

(52) U.S. Cl.
USPC ..... 166/372; 166/68

(58) Field of Classification Search
USPC ..... 166/372, 68, 105
See application file for complete search history.

(56) References Cited

U.S. PATENT DOCUMENTS

| | | | | |
|---|---|---|---|---|
| 6,148,923 | A | 11/2000 | Casey | |
| 6,209,637 | B1 | 4/2001 | Wells | |
| 6,467,541 | B1 | 10/2002 | Wells | |
| 6,688,385 | B1 | 2/2004 | Moe | |
| 6,719,060 | B1 | 4/2004 | Wells | |
| 6,725,916 | B2 * | 4/2004 | Gray et al. | 166/68.5 |
| 7,080,692 | B1 * | 7/2006 | Kegin | 166/372 |
| 7,243,730 | B2 | 7/2007 | Casey | |
| 7,314,080 | B2 | 1/2008 | Giacomino | |
| 7,383,878 | B1 | 6/2008 | Victor | |
| 7,448,442 | B2 | 11/2008 | Wells | |
| 7,451,823 | B2 * | 11/2008 | Wilson | 166/372 |
| 7,513,301 | B2 * | 4/2009 | Victor | 166/105 |
| 8,181,706 | B2 * | 5/2012 | Tanton | 166/372 |
| 2004/0226713 | A1 * | 11/2004 | Townsend | 166/105 |

OTHER PUBLICATIONS

Weatherford, "Single-Outlet Lubricator," Brochure, copyright 2005.
Weatherford, "Dual-Outlet Lubricator," Brochure, copyright 2005.
Weatherford, "T-Pad Plunger," Brochure, copyright 2005.
Weatherford, "Fixed Brush Plunger," Brochure, copyright 2005-2008.
Weatherford, "Spiral Plunger," Brochure, copyright 2005.
Weatherford, "Combination Plunger," Brochure, copyright 2005.
Weatherford, "Auto-Catch Assembly," Brochure, copyright 2007.
Weatherford, "Union Lubricator," Brochure, copyright 2008.
Weatherford, "Plunger-Lift Systems 2008 Catalog," Catalog, copyright 2005-2008.

* cited by examiner

*Primary Examiner* — Daniel P Stephenson
(74) *Attorney, Agent, or Firm* — Wong, Cabello, Lutsch, Rutherford & Brucculeri, L.L.P.

(57) ABSTRACT

A plunger lift system has a plunger with main and ancillary sleeves that dispose in tubing. The sleeves can move in the tubing between a bumper and a lubricator. Both sleeves have a passage for fluid to pass therethrough, and the sleeves can fall independently of one another from the surface to the bumper. When disposed on the bumper, the sleeves mate together. Building gas pressure downhole can then lift the mated sleeves, which push a column of liquid along with them to the surface. The main sleeve has a narrow stem on its distal end with openings that communicate with the sleeve's passage. A nodule also extends from the distal end. The ancillary sleeve fits at least partially on the narrow stem, and an orifice in the sleeve's opening engages on the nodule. Thus, the mated sleeves close off fluid communication through the main sleeve's passage.

39 Claims, 5 Drawing Sheets

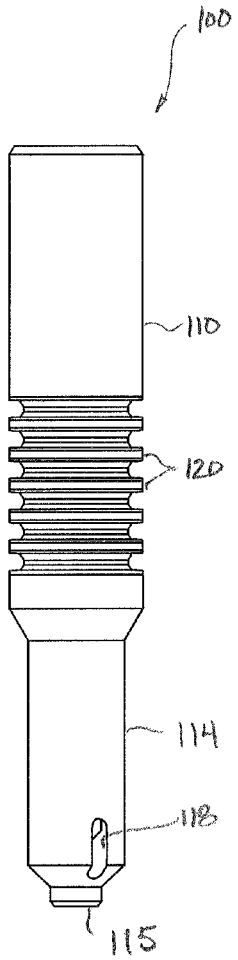
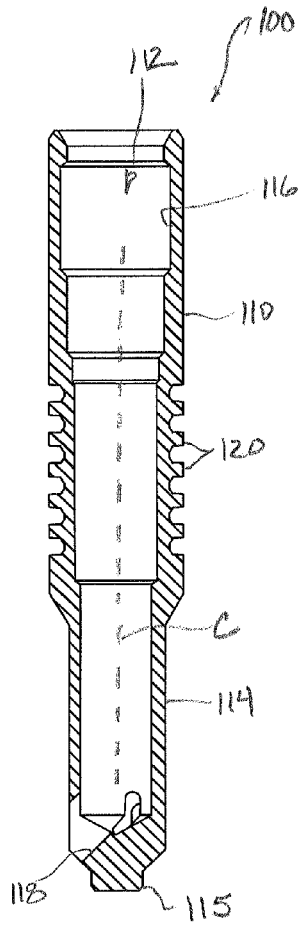
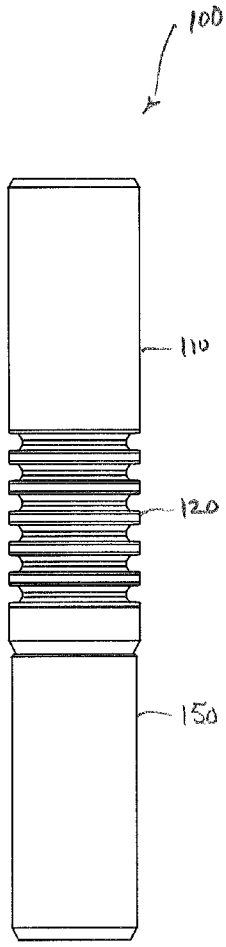
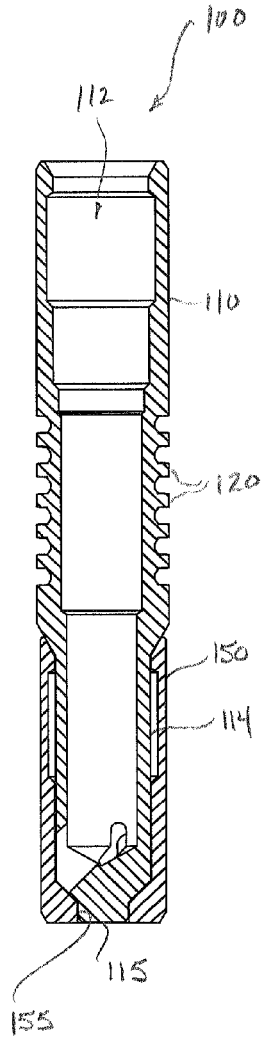
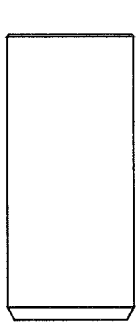
Fig.4A
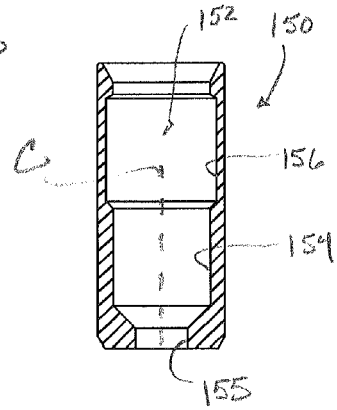
Fig.4B
Fig.5A
Fig.5B

MULTI-SLEEVE PLUNGER FOR PLUNGER LIFT SYSTEM

BACKGROUND

Liquid buildup can occur in aging production wells and can reduce the well's productivity. To handle the buildup, operators can use beam lift pumps or other remedial techniques, such as venting or "blowing down" the well. Unfortunately, these techniques can cause gas losses. Moreover, blowing down the well can produce undesirable methane emissions. In contrast to these techniques, operators can use a plunger lift system, which reduces gas losses and improves well productivity.

A plunger lift system 10 of the prior art is shown in FIG. 1. In the system 10, a plunger 50A disposes in production tubing 16, which deploys in casing 14 from a wellhead 12. During operation, the plunger 50A moves between a lubricator 30 at the surface and a landing bumper 20 downhole. The plunger 50A shown in FIG. 1 is a two-piece plunger. However, a typically plunger 50B as shown in FIG. 2B has a solid or a semi-hollow plunger body 80 with external ribbing 84 or the like for creating a pressure differential.

The two-piece plunger 50A of FIG. 1 allows both pieces to fall faster downhole than would be possible for such a solid or semi-hollow plunger 50B of the prior art. As best shown in FIG. 2A, the two-piece plunger 50A has a separate sleeve 60 and ball 70. The sleeve 60 has an inner bore 62 that defines a seat 68. The ball 70 can fit against the seat 68 and can seal fluid flow up through the plunger's bore 62 during operation. The sleeve's outer surface can have ribbing 64 or the like for creating a pressure differential.

When used in the system 10 of FIG. 1, the sleeve 60 and ball 70 dispose separately in the tubing 16. Operators drop the ball 70 first to land near the bottom of the well. The ball 70 falls into any liquid near the bottom of the well and contacts the bumper 20. Operators drop the sleeve 60 after the ball 70 so it can fall to the bumper 20 as well.

When the sleeve 60 reaches the ball 70, they unite into a single component. With the plunger 50A deployed to handle liquid buildup, operators set the well in operation. Gas from the formation enters through casing perforations 18 and travels up the production tubing 16 to the surface, where it is produced through lines 32/34 at the lubricator 30. Liquids may accumulate in the well and can create back pressure that can slow gas production through the lines 32/34. Using sensors and the like, a controller 36 operates a valve 38 at the lubricator 30 to regulate the buildup of pressure in the tubing 16. Sensing the slowing gas production due to liquid accumulation, the controller 36 shuts-in the well to increase pressure in the well.

As high-pressure gas accumulates, the well reaches a sufficient volume of gas and pressure. Eventually, the gas pressure buildup pushes against the combined sleeve 60 and ball 70 and lifts them together to the lubricator 30 at the surface. The column of liquid accumulated above the plunger 50A likewise moves up the tubing 16 to the surface so that the liquid load can be removed from the well.

In this way, the plunger 50 essentially acts as a piston between liquid and gas in the tubing 16. Gas entering the production string 16 from the formation through the casing perforations 18 acts against the bottom of the plunger 50A (mated sleeve and ball 60/70) and tends to push the plunger 50A uphole. At the same time, any liquid above the plunger 50A will be forced uphole to the surface by the plunger 50A.

As the plunger 50A rises, for example, the controller 36 allows gas and accumulated liquids above the plunger 50A to flow through lines 32/34. Eventually, the plunger 50A reaches a catcher 40 on the lubricator 30 and a spring (not shown) absorbs the upward movement. The catcher 40 captures the plunger's sleeve 60 when it arrives, and the gas that lifted the plunger 50 flows through the lower line 32 to the sales line. A decoupler (not shown) inside the lubricator 30 separates the ball 70 from the sleeve 60. The ball 70 can then immediately fall toward the bottom of the well. The catcher 40 holds the sleeve 60 and then releases the sleeve 60 after the ball 70 is already on its way down the tubing 16.

Dropped in this manner, the sleeve 60 and ball 70 fall independently inside the production tubing 16. The sleeve 60 with its central passage 62 can have gas flow through it as the sleeve 60 falls in the well. On the other hand, flow travels around the outside of the ball 70 as the ball 70 falls in the well. Unfortunately, the ball 70 tends to fall slower than the sleeve 60. Therefore, the system 10 must properly time the dropping of the ball 70 and sleeve 60 so that the ball 70 has sufficient time to fall downhole before the sleeve 60 is allowed to fall. Solutions for decoupling the ball 70 and for timing the dropping of the ball 70 and the sleeve 60 are disclosed in U.S. Pat. Nos. 6,719,060; 6,467,541; and 7,383,878, for example. Although such schemes may be effective, what is needed is a more robust approach with less complexity.

The subject matter of the present disclosure is directed to overcoming, or at least reducing the effects of, one or more of the problems set forth above.

SUMMARY

A plunger lift system has a plunger with a main sleeve and an ancillary sleeve that dispose in tubing downhole. The sleeves move uphole in the tubing from a dowhole bumper to an uphole lubricator when downhole pressure acts against the mated sleeves. Both sleeves have a passage therethrough for fluid communication, and the sleeves can fall independently of one another from the surface to the downhole bumper. Preferably, the ancillary sleeve falls at a faster rate downhole than the main sleeve. When downhole, however, the sleeves mate together and prevent passage of fluid through the sleeves. As gas pressure builds downhole, the gas ultimately lifts the mated sleeves and pushes a column of liquid above the sleeves to the surface.

The main sleeve disposes in the tubing uphole of the ancillary sleeve. The main sleeve has a narrow stem on its distal end with openings that communicate with the sleeve's internal passage. A nodule also extends from the distal end.

As noted previously, the ancillary sleeve disposes in the tubing downhole from the main sleeve. The uphole end of the ancillary sleeve fits at least partially on the narrow stem of the main sleeve. When mated, the ancillary sleeve closes off fluid communication through the main sleeve's passage. Likewise, the nodule on the main sleeve engages in the ancillary sleeve's orifice so the fluid communication through the ancillary sleeve's passage is also closed off.

The plunger lift system also has a downhole bumper that provides a cushioned landing for the sleeves. At the surface, the plunger lift system has a lubricator with a valve and a catcher. A controller at the lubricator can control the passage of fluid flow by operating the valve based on conditions in the tubing. This can allow the controller to build pressure in the tubing for a plunger lift cycle. When the mated sleeves reach the surface by application of fluid pressure from downhole, the catcher can engage the main sleeve. The catcher can be manual or can be operated automatically by the controller. The ancillary sleeve in contrast to the main sleeve is free to fall downhole in advance of the main sleeve. Once both sleeves have been dropped, the two sleeves mate downhole at the bumper again so the plunger lift cycle can repeat itself.

The foregoing summary is not intended to summarize each potential embodiment or every aspect of the present disclosure.

BRIEF DESCRIPTION OF THE DRAWINGS

FIGS. 4A-4B show side and cross-sectional views of the multi-sleeve plunger in a uncombined condition.

FIGS. 5A-5B show side and cross-sectional views of the multi-sleeve plunger in a combined condition.

DETAILED DESCRIPTION

Figure 1:
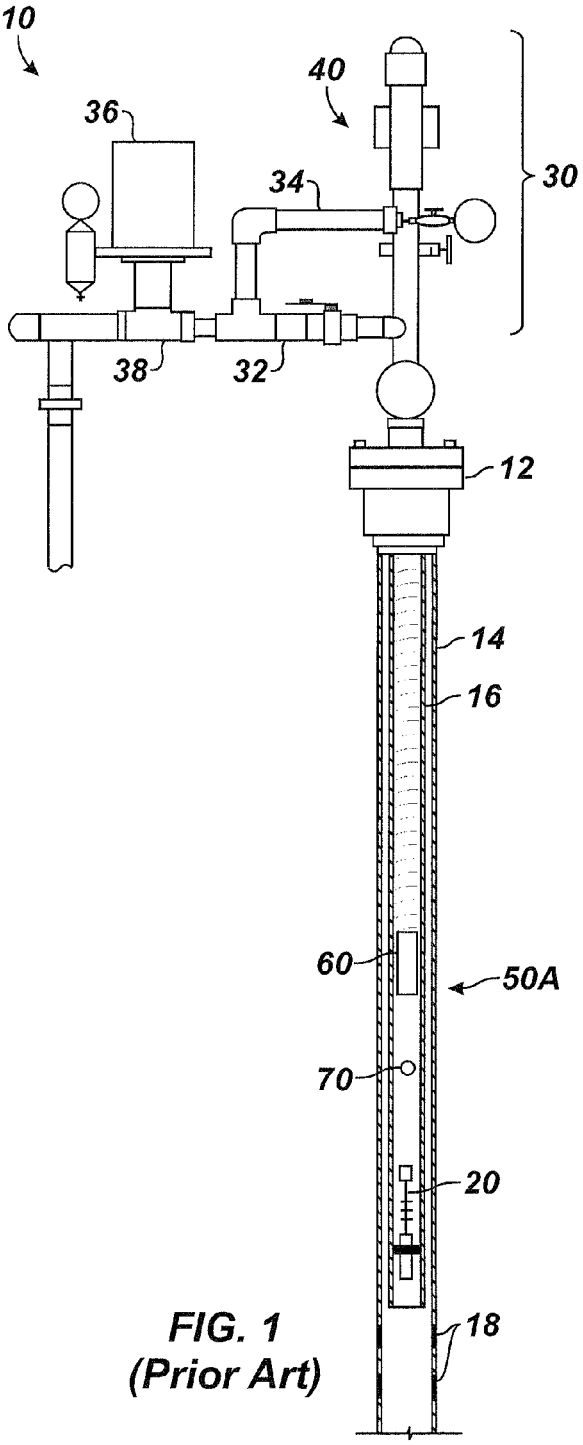
FIG. 1 (Prior Art)
FIG. 1 illustrates a plunger lift system according to the prior art.
Figure 2A:
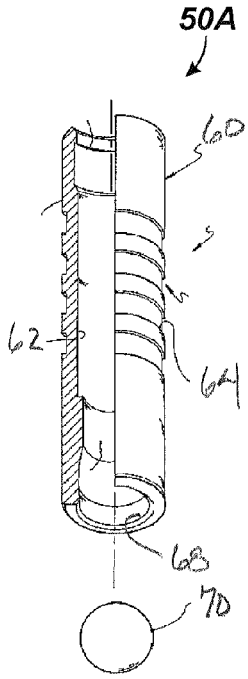
FIG. 2A (Prior Art)
FIG. 2A illustrates a partial cross-section of a multi-piece plunger according to the prior art.
Figure 2B:
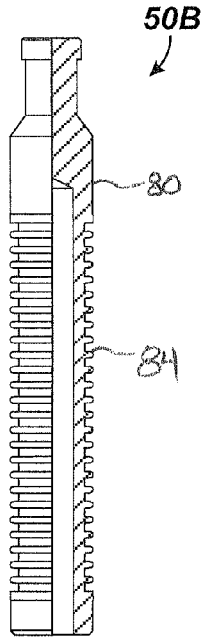
FIG. 2B (Prior Art)
FIG. 2B illustrates a partial cross-section of a semi-hollow plunger according to the prior art.
Figure 3A:
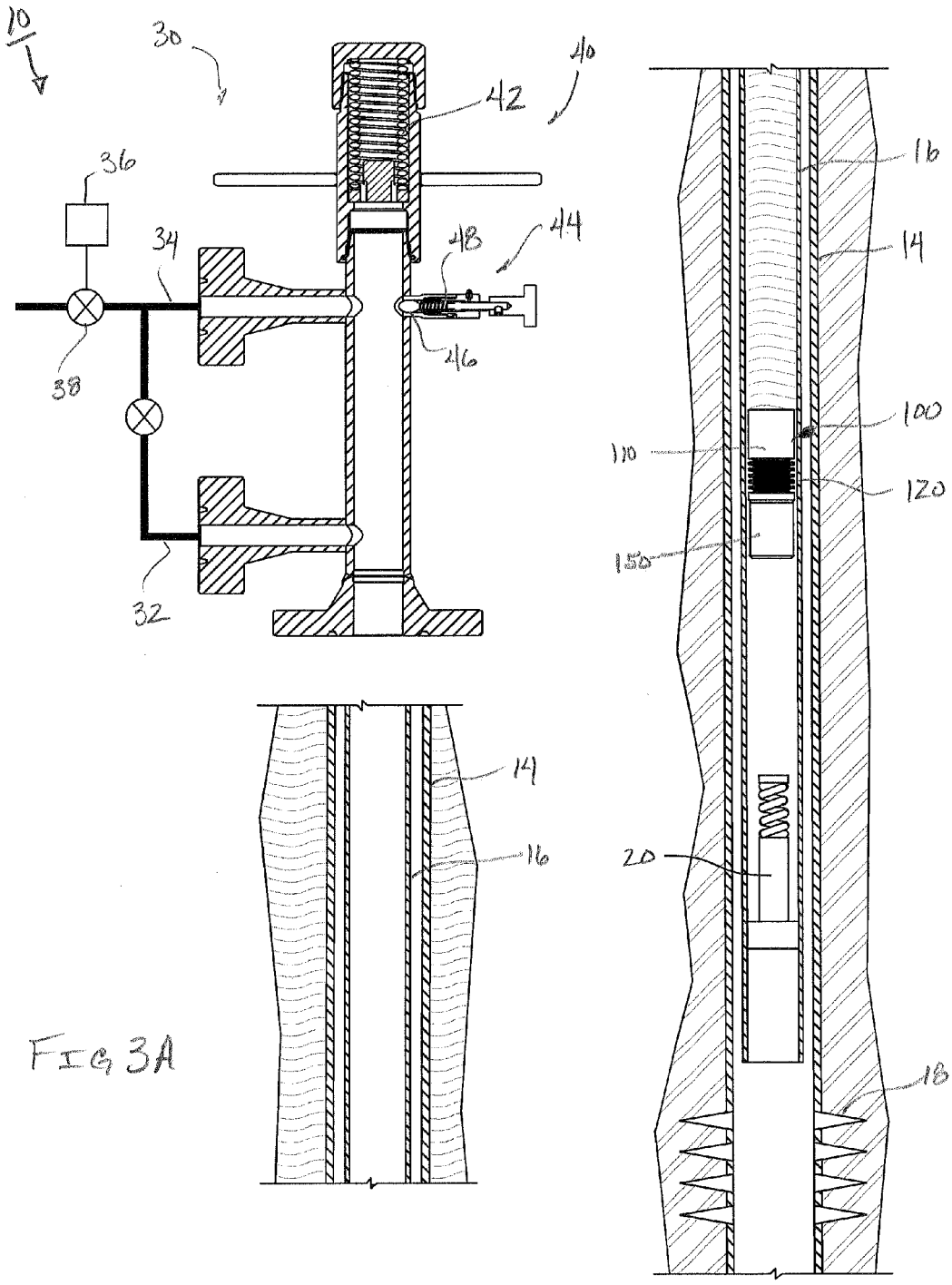
FIGS. 3A-3B illustrates a plunger lift system having a multi-sleeve plunger according to the present disclosure.
Figure 3B:
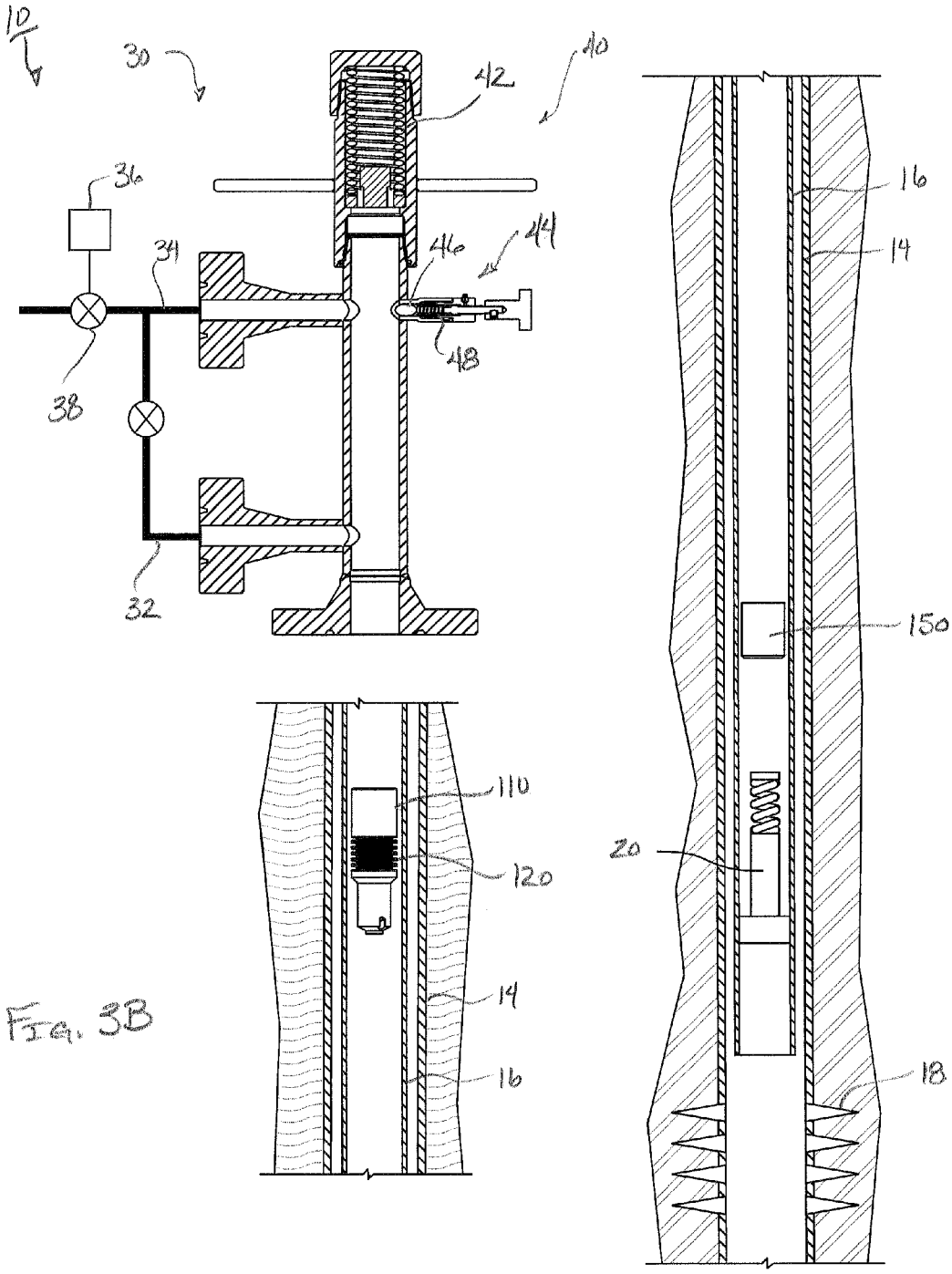

A gas well in FIGS. 3A-3B has a plunger lift system 10 to handle the accumulation of formation liquid in the well. In an earlier stage of the well's productive life, a sufficient amount of gas may have been produced to deliver the formation liquids to the surface. However, due to the age of the well or other factors, the plunger lift system 10 may need to handle issues with liquid buildup in the well. In general, the plunger lift system 10 can lift oil, condensate, or water from the bottom of the well to the surface.

As shown, the well has production tubing 16 disposed in casing 14, which extend from a wellhead (not shown). Formation fluids enter the casing 14 via casing perforations 18. The produced fluids then enter the production tubing 16 and bypass a bottomhole bumper 20 positioned downhole. At the wellhead, a lubricator 30 routes produced fluids to a sales line.

A multi-sleeve plunger 100 disposes in the tubing 16 and can move between the bumper 20 and the lubricator 30 to lift accumulated liquid to the surface. As shown briefly in FIG. 3A, the plunger 100 has a main sleeve 110 and a separate ancillary sleeve 150. These two sleeves 110/150 can fit together to complete the plunger 100. (Further details of the plunger 100 are provided later.)

Initially, the plunger 100 rests on the bottomhole bumper 20 toward the base of the well. When disposed at the bumper 20, the two sleeves 110/150 mate together. As gas is produced through lines 32/34 on the lubricator 30, liquids may accumulate in the wellbore and create back-pressure that can slow gas production. Using sensors and the like, a controller 36 operates a valve 38 at the lubricator 30 to regulate the buildup of gas in the tubing 16. Sensing the slowing gas production, the controller 36 shuts-in the well to increase pressure in the well as high-pressure gas begins to accumulate.

When sufficient gas volume and pressure level are reached, the gas pushes against the plunger 100 and eventually pushes the plunger 100 upward from the bumper 20 toward the lubricator 30 as illustrated in FIG. 3A. The column of liquid above the moving plunger 100 likewise moves up the tubing 16 so the liquid load can eventually be removed from the well at the surface. In this way, the plunger 100 essentially acts as a piston between liquid and gas in the tubing 16.

As the plunger 100 rises, the controller 36 allows gas and accumulated liquids above the plunger 100 to flow through the outlets 32/34. Eventually, the plunger 100 reaches the lubricator 30, and a spring 42 absorbs the plunger's impact. A catcher 44 in the assembly 40 can then capture the plunger's main sleeve 110 if desired. Meanwhile, the gas that lifted the plunger 100 flows through the lower outlet 32 to the sales line. Once the gas flow stabilizes, the controller 36 can shut-in the well and releases the main sleeve 110, which drops back downhole to the bumper 20. Ultimately, the cycle can repeat itself.

The catcher 44 can hold the main sleeve 110 and can control the release of the main sleeve 110 to fall downhole after the ancillary sleeve 150. Yet, in some circumstances, using the catcher 44 to hold the main sleeve 110 may not be required during a lift cycle. Instead, the main sleeve 110 can be held in the lubricator 30 by the immediate uphole flow of gas during the lift cycle. This may occur for a sufficient amount of time after the ancillary sleeve 150 has descended into the well.

For its part, the ancillary sleeve 150 is free to drop off the main sleeve 110 when pressure fails to support it thereon. Thus, the ancillary sleeve 150 can promptly fall off the main sleeve 110 and toward the bottom of the well. Accordingly, a particular decoupler is not needed for this implementation to decouple the ancillary sleeve 150.

In general, the catcher 44 can have a conventional design when used. As shown in FIGS. 3A-3B, for example, the catcher 44 has a biased ball 46 that can latch onto the main sleeve 110 and hold it. For example, the ball 46 can engage in grooves or detents of sleeve's ribbing 120 or in some other suitable profile or shoulder. In one implementation, the catcher 44 can be manually operated. As such, the catcher 44 can catch the main sleeve 110 in the lubricator 30 so the sleeve 110 can be released manually by hand or can be retrieved and inspected as needed.

Alternatively, the catcher 44 can be automated. In such an auto catch assembly, the catcher 44 can automatically catch the plunger's main sleeve 110 when it arrives at the surface during a lift cycle. A sensor can be used to detect the plunger's arrival if necessary.

The controller 36 can then indicate when the main sleeve 110 is to trip downhole rather than allowing the sleeve 110 to drop when the flow rate momentarily decreases. For such an automated catcher 44, a spring and piston arrangement 48 can bias the ball 46 using compressed gas from a source controlled by the controller 36. The pressure can be applied to the spring and piston arrangement 48 using diaphragm topworks (not shown) or other device. With pressure applied, the ball 46 forces into the lubricator's pathway so the ball 46 can engage the plunge's main sleeve 110. The controller 36 can release gas pressure from the spring and piston arrangement 48. At this point, the weight of the main sleeve 110 can push the ball 46 out of the way so the sleeve 110 is free to fall into the well.

As shown in FIG. 3B, the ancillary sleeve 150 drops first into the well either because it is not held by the catcher 44 (if present) and is free to fall with less restriction. The main sleeve 110 follows so that the sleeves 110/150 fall separately and independently of one another down the tubing 16. This enables the plunger 100 to fall faster downhole and with less restriction than a solid or semi-hollow type of plunger.

Because the ancillary sleeve 150 may fall promptly, it may fall while the well is still flowing. Because it is a sleeve with an internal passage and smooth external surface, the ancillary sleeve 150 can avoid issues encountered by dropped balls or the like and may be able to avoid friction issues and other problems when falling against flow. Nevertheless, the ancillary sleeve 150 is preferably designed to fall faster than the main sleeve 110. Therefore, timing the dropping of the two sleeves 110/150 may not be as much of an issue in the plunger lift system's operation than found in other systems.

When the separate sleeves 110/150 reach the bottom of the well, they nest together in preparation for moving upwardly once pressure builds up. For example, the ancillary sleeve 150 falls into any liquid near the bottom and lands on the bumper 20. The main sleeve 110 drops after the ancillary sleeve 150 to the bumper 20. When the main sleeve 110 reaches the ancillary sleeve 150, they unite into a single component. Any gas entering the tubing 16 from the formation then starts to act against the bottom of the mated sleeves 110/150 and tends to push them together uphole. In this way, any new liquid above the mated sleeves 110/150 can be forced uphole to the surface.

Turning to FIGS. 4A-4B and 5A-5B, further details of the plunger 100 are discussed. As shown in FIGS. 4B and 5B, the main sleeve 110 has a cylindrical body with an internal passage 112 through which flow can pass as the sleeve 110 falls in the well. Similarly, the ancillary sleeve 150 as shown in FIGS. 4B and 5B also has a cylindrical body with an internal passage 152 through which flow can pass as the sleeve 150 falls in the well.

Turning to the main sleeve 110, the exterior of the main sleeve 110 can have ribbing 120 or other features for creating a pressure differential across the sleeve 110 when disposed in tubing. The ribbing 120 may be of any suitable type, including wire windings or a series of grooves or indentations. The ribbing 120 creates a turbulent zone between the sleeve 110 and the inside of the producing tubing, which restricts liquid flow on the outside of the sleeve 110. The ribbing 120 can also be used as a catch area for holding the sleeve 110 at the wellhead, as described previously.

The sleeve's internal passage 112 can define a fish neck or other profile 116 allowing for retrieval of the sleeve 110 if needed. At its distal end, the main sleeve 110 defines a narrow stem 114 on which the ancillary sleeve 150 can fit when mated thereto. The distal end of this narrow stem 114 has a nodule 115 and defines ports 118 communicating with the sleeve's internal passage 112. These ports 118 allow flow through the main sleeve's internal passage 112 as it falls in the well.

Turning to the ancillary sleeve 150, its internal passage 152 can also have a fish neck profile 156 for retrieval. The uphole end of the ancillary sleeve 150 is open to fit onto the main sleeve's narrow stem 114. The lower end of the ancillary sleeve 150, however, is closed except for an orifice 155 through which the nodule 115 of the main sleeve 110 can fit when mated thereto.

As shown in FIGS. 4A-4B, the two sleeves 110/150 when uncombined can allow fluid to pass through their passages 112/152 as they fall down the tubing. As alluded to previously, the ability of fluid to pass through the sleeves 110/150 enables both sleeves 110/150 to fall more readily in the tubing from the surface, even if the well is flowing. Thus, the open proximal end of the main sleeve's passage 112 preferably aligns with its centerline C as shown in FIG. 4B. Likewise, the distal openings 118 around the sleeve's nodule 115 also preferably align with the centerline C as much as possible for more direct passage of flow through the sleeve 110 when dropping in the well.

The same is true for the ancillary sleeve 150 so that both the open proximal end and the distal orifice 155 preferably align with the passage's centerline C. As will be appreciated, the surface areas of the sleeves 110/150 against which flow acts, the weight of the sleeves 110/150, their diameters, the number of openings 118, and other variables can be designed for a particular implementation and can depend on several factors, such as size of tubing, expected gas flow, formation fluid properties, etc.

As shown in FIGS. 5A-5B, the two sleeves 110/150 can combine or mate with one another to close off fluid flow therethrough. This occurs when the sleeves 110/150 are disposed on the bumper or when pressure lifts the sleeves 110/150 and liquid column to the surface. When combined as shown in FIG. 5B, the ancillary sleeve 150 covers the slots 118 in the main sleeve's stem 114, and the stem's nodule 115 closes off the ancillary sleeve's orifice 155.

Figure 6A:
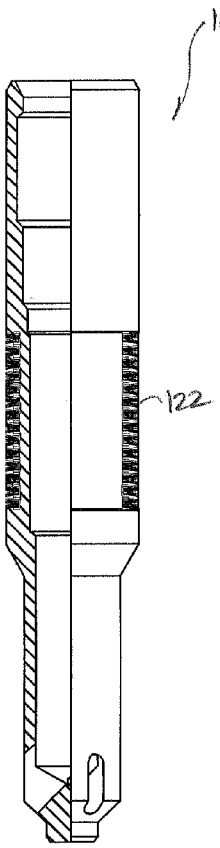
FIGS. 6A-6B show the main sleeve of the disclosed plunger with alternative features.
Figure 6B:
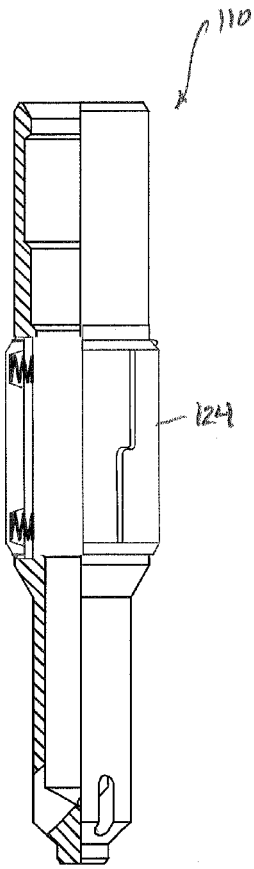

As noted above, the main sleeve's exterior can have ribbing 120 or other features for creating a pressure differential across the sleeve 110 when disposed in tubing. For example, the main sleeve 110 as shown in FIGS. 6A-6B can have a plurality of fixed brushes 122 or biased T-pads 124 for creating the pressure differential. In general, these and other known features can be used on the main sleeve 110 for this purpose. However, the ancillary sleeve 150 can have a smooth exterior surface as shown in FIGS. 4A and 5A, although it could have some feature to create a pressure differential if desired.

Figure 7A:
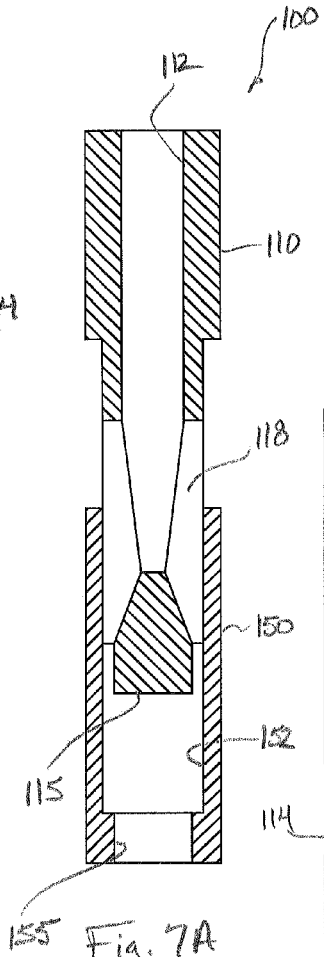
FIGS. 7A-7B show cross-sectional views of additional multi-sleeve plunger in partially combined conditions.
Figure 7B:
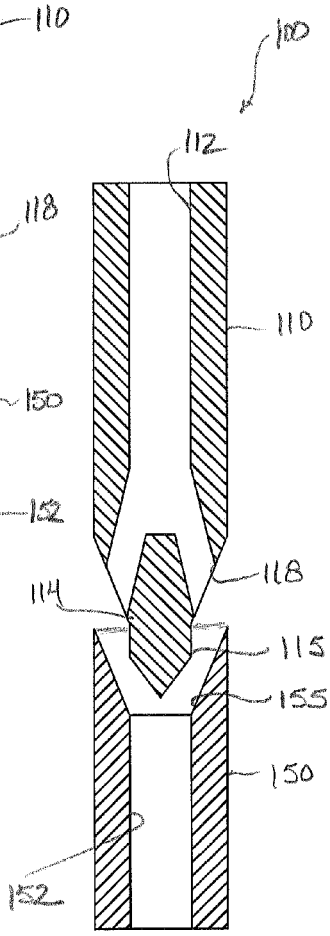

FIGS. 7A-7B show cross-sectional views of additional multi-sleeve plungers 100 in partially combined conditions. Although shown without features for creating a pressure differential, these plungers 100 can have the same features as discussed previously. As shown in FIG. 7A, for example, the main sleeve's slots 118 can be extended up the length of the sleeve's stem 114, which may improve the passage of flow through the main sleeve 110 when dropping in the well. The nodule 115 on the sleeve 110 can have a wide diameter so that the orifice 155 on the ancillary sleeve 150 can have increased diameter. This wider orifice 155 may be beneficial for the passage of fluid as the sleeve 150 drops in the well, especially if the well is still flowing as the sleeve 150 falls.

As shown in FIG. 7B, the main sleeve's slots 118 can be more centrally located in line with the sleeve's passage 112. This may improve the passage of flow through the main sleeve 110 when dropping in the well. Also, the ancillary sleeve 150 may be designed for less engagement with the stem 114 on the main sleeve 110. As will be appreciated with the benefit of the present disclosure, these and other modifications can be made to the two sleeves 110/150 of the plunger 100 to suit a particular implementation.

The foregoing description of preferred and other embodiments is not intended to limit or restrict the scope or applicability of the inventive concepts conceived of by the Applicants. Although the multi-sleeve plunger disclosed herein includes at least two sleeves with internal passages, for example, it will be appreciated with the benefit of the present disclosure that the disclose plunger can have more than two sleeves that move independently of one another in the tubing and that close off fluid communication therethrough when mated together. In other words, the disclosed plunger can have two or more sleeves similar to the main sleeve 110 of FIG. 4A that mate with one another. Such a plunger can then have an ancillary sleeve 150 of FIG. 4A that mates with the last of the main sleeves to ultimately close off fluid communication through the plunger.

Moreover, the sleeves of the disclosed multi-sleeve plunger have been depicted without seals. Use of seal may be unnecessary for at least partially closing off fluid communication between the sleeves when mated together so the mated sleeves can be pushed uphole by pressure. However, it will be appreciated that seals may be used on the sleeves, but the seals are preferably used on abutting surfaces so as not to interfere with the free decoupling between the sleeves.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A plunger lift apparatus, comprising:

a first sleeve for disposing in tubing of a well, the first sleeve defining a first passage from a first proximal end to a first distal end; and a second sleeve for disposing in the tubing downhole of the first sleeve, the second sleeve defining a second passage from a second proximal end to a second distal end, the second sleeve being separately movable in the tubing between mated and unmated conditions with respect to the first sleeve, the second proximal end of the second sleeve at least partially mating with the first distal end of the first sleeve when in the mated condition and at least partially closing fluid communication through the first passage of the first sleeve when mated therewith.

2. The apparatus of claim 1, wherein the first sleeve comprises means for producing a pressure differential across the first sleeve.

3. The apparatus of claim 1, wherein the first and second sleeves mated together move uphole within the tubing by application of a pressure differential.

4. The apparatus of claim 1, wherein the second sleeve deploys at a faster rate downhole in the tubing than the first sleeve.

5. The apparatus of claim 1, further comprising a catcher disposing uphole of the tubing and operable to engage the first sleeve.

6. The apparatus of claim 5, further comprising a controller operably coupled to the catcher and controlling engagement of the catcher with the first sleeve.

7. The apparatus of claim 1, further comprising:

a valve in fluid communication with the tubing; and a controller operably coupled to the valve and controlling the valve in response to conditions in the tubing.

8. The apparatus of claim 1, wherein the first distal end of the first sleeve comprises a nodule extending beyond at least one first distal opening of the first passage, and wherein the second distal end of the second sleeve defines an orifice of the second passage through which the nodule disposes when the second sleeve mates with the first sleeve.

9. The apparatus of claim 1, wherein the first distal end of the first sleeve comprises a stem at least partially disposing in the second passage of the second sleeve when mated therewith.

10. The apparatus of claim 1, wherein the first passage has a first proximal opening toward the first proximal end and has at least one first distal opening toward the first distal end.

11. The apparatus of claim 10, wherein the second passage has a second proximal opening toward the second proximal end and has a second distal opening toward the second distal end, the first distal end at least partially fitting in the second proximal opening, the second sleeve at least partially closing off fluid communication through the at least one first distal opening when mated with the first sleeve.

12. A plunger lift apparatus, comprising:

a first sleeve for disposing in tubing of a well, the first sleeve defining a first passage therethrough, and a second sleeve for disposing in the tubing downhole of the first sleeve, the second sleeve mating with the first sleeve downhole and at least partially closing fluid communication through the first passage of the first sleeve when mated therewith, the second sleeve defining a second passage therethrough and deploying at a faster rate downhole in the tubing than the first sleeve.

13. The apparatus of claim 12, wherein the first sleeve comprises means for producing a pressure differential across the first sleeve.

14. The apparatus of claim 12, wherein the first and second sleeves mated together move uphole within the tubing by application of a pressure differential.

15. The apparatus of claim 12, further comprising a catcher disposing uphole of the tubing and operable to engage the first sleeve.

16. The apparatus of claim 15, further comprising a controller operably coupled to the catcher and controlling engagement of the catcher with the first sleeve.

17. The apparatus of claim 12, further comprising:

a valve in fluid communication with the tubing; and a controller operably coupled to the valve and controlling the valve in response to conditions in the tubing.

18. The apparatus of claim 12, wherein the first sleeve comprises a nodule disposed on a distal end thereof and extending beyond at least one first distal opening of the first passage.

19. The apparatus of claim 18, wherein the second sleeve defines an orifice of the second passage on a distal end thereof, the nodule of the first sleeve at least partially disposing in the orifice when the second sleeve mates with the first sleeve.

20. The apparatus of claim 12, wherein the first sleeve comprises a distal stem at least partially disposing in the second passage of the second sleeve when mated therewith.

21. The apparatus of claim 12, wherein the first passage has a first proximal opening toward a first proximal end of the first sleeve and has at least one first distal opening toward a first distal end of the first sleeve.

22. The apparatus of claim 21, wherein the second passage has a second proximal opening toward a second proximal end of the second sleeve and has a second distal opening toward a second distal end of the second sleeve, the first distal end at least partially fitting in the second proximal opening, the second sleeve at least partially closing off fluid communication through the at least one first distal opening when mated with the first sleeve.

23. A plunger lift apparatus, comprising:

a first sleeve for disposing in tubing of a well, the first sleeve having a first proximal end and a first distal end and defining a first passage for fluid communication therethrough, the first passage having a first proximal opening toward the first proximal end and having at least one first distal opening toward the first distal end; and a second sleeve for disposing in the tubing downhole of the first sleeve, the second sleeve having a second proximal end and a second distal end and defining a second passage for fluid communication therethrough, the second passage having a second proximal opening toward the second proximal end and having a second distal opening toward the second distal end, the second proximal end at least partially mating with the first distal end of the first sleeve and closing fluid communication through the at least one first distal opening when mated therewith, wherein the first distal end of the first sleeve comprises a nodule extending beyond the at least one first distal opening of the first passage, the nodule disposing in the second distal opening of the second sleeve when the second sleeve mates with the first sleeve.

24. The apparatus of claim 23, wherein the first sleeve comprises means for producing a pressure differential across the first sleeve.

25. The apparatus of claim 23, wherein the first and second sleeves mated together move uphole within the tubing by application of a pressure differential.

26. The apparatus of claim 23, wherein the second sleeve deploys at a faster rate downhole in the tubing than the first sleeve.

27. The apparatus of claim 23, further comprising a catcher disposing uphole of the tubing and operable to engage the first sleeve.

28. The apparatus of claim 27, further comprising a controller operably coupled to the catcher and controlling engagement of the catcher with the first sleeve.

29. The apparatus of claim 23, further comprising:

a valve in fluid communication with the tubing; and a controller operably coupled to the valve and controlling the valve in response to conditions in the tubing.

30. The apparatus of claim 23, wherein the first distal end of the first sleeve comprises a stem at least partially disposing in the second passage of the second sleeve when mated therewith.

31. The apparatus of claim 30, wherein the stem of the first sleeve at least partially fits in the second passage of the second sleeve and at least partially closes off fluid communication through the first and second passages when the second sleeve is mated with the first sleeve.

32. A plunger lift method, comprising:

deploying an ancillary sleeve downhole in tubing of a well by allowing fluid communication through the ancillary sleeve;

deploying a main sleeve downhole in the tubing by allowing fluid communication through the main sleeve;

preventing fluid communication through the ancillary and main sleeves by mating the ancillary and main sleeves together;

lifting the mated ancillary and main sleeves uphole in the tubing by application of a pressure differential.

33. The method of claim 32, further comprising catching the main sleeve lifted uphole in the tubing.

34. The method of claim 33, further comprising redeploying the main sleeve downhole in the tubing by releasing the main sleeve manually or automatically.

35. The method of claim 32, further comprising redeploying the ancillary sleeve downhole in the tubing by unmating the ancillary sleeve from the main sleeve lifted uphole in the tubing.

36. The method of claim 35, wherein redeploying the ancillary sleeve comprises permitting the ancillary sleeve to deploy downhole in the tubing before permitting the main sleeve to deploy downhole.

37. The method of claim 32, wherein lifting the mated ancillary and main sleeves uphole in the tubing by application of a pressure differential comprises building pressure in the tubing by shutting in the well.

38. The method of claim 32, wherein lifting the mated ancillary and main sleeves uphole in the tubing by application of a pressure differential comprises creating a pressure differential across an outside surface of the main sleeve.

39. The method of claim 32, wherein deploying the ancillary sleeve downhole in the tubing comprises permitting the ancillary sleeve to deploy at a faster rate downhole than the main sleeve.

* * * * *